US007225573B2

(12) United States Patent
Shaffer

(10) Patent No.: US 7,225,573 B2
(45) Date of Patent: Jun. 5, 2007

(54) CONVERTIBLE BILLBOARD DISPLAY

(76) Inventor: William H. Shaffer, P.O. Box 2174, Cinnaminson, NJ (US) 08077

( * ) Notice: Subject to any disclaimer, the term of this patent is extended or adjusted under 35 U.S.C. 154(b) by 105 days.

(21) Appl. No.: 11/204,857

(22) Filed: Aug. 16, 2005

(65) Prior Publication Data

US 2007/0039218 A1 Feb. 22, 2007

(51) Int. Cl.
*G09D 3/04* (2006.01)

(52) U.S. Cl. ..... 40/661.08; 40/124.05; 40/124.06; 40/124.09; 40/124.12; 40/124.15; 40/661.03; 40/661.09; 434/465; 434/365; 434/430

(58) Field of Classification Search ..... 40/124.05, 40/124.06, 124.09, 124.12, 124.15, 661.03, 40/661.06, 661.09, 661.08; 434/365, 430; 160/87, 160
See application file for complete search history.

(56) References Cited

U.S. PATENT DOCUMENTS 689,183 A * 12/1901 Baker ..... 209/631
1,463,326 A * 7/1923 Kristofek ..... 40/661.08
2,881,662 A * 4/1959 Harris ..... 248/472
3,755,938 A * 9/1973 Bytwork ..... 40/530
4,288,935 A * 9/1981 Cross ..... 40/120
4,541,190 A * 9/1985 Weiner et al. ..... 40/610

* cited by examiner

*Primary Examiner*—Lesley D. Morris
*Assistant Examiner*—Shin Kim
(74) *Attorney, Agent, or Firm*—Stuart M. Goldstein

(57) ABSTRACT

A lightweight, easily portable, convertible billboard display has three panels rotatably connected to each other in parallel fashion. The billboard display can be used as a vertically standing three panel display or, when two of the panels are connected by a removable connection component, as a three dimensional triangular display. Informational display items can be removably attached to the display panels. In addition, pockets, variously located within each panel, allow for the insertion and display of and full access to multi-page display items, mounted directly on the billboard display.

18 Claims, 4 Drawing Sheets

CONVERTIBLE BILLBOARD DISPLAY

BACKGROUND OF THE INVENTION

Self-standing display systems are commonly used by educators, lecturers, sales people and others who exhibit and display visual aids, advertising, or instructional information. Such systems routinely employ a number of interconnected panels which are either freestanding and rest on the bottom edges of the panels, or are paneled systems which are positioned on support legs. The panels have surfaces to which posters, brochures, textural documents, advertisements, or similar material can be temporarily, but securely attached for display. Attachment is accomplished by commonly available means, e.g. Velcro®, clips, pushpins, tape, adhesive or the like.

However, there currently are no display systems which are very lightweight for portability and also are versatile enough to be easily converted to a number of different configurations, depending on desired usage. For instance, the system disclosed in U.S. Pat. No. 6,779,286, while providing an excellent convertible display, is a relatively large frame supported unit which is often used for exhibiting to larger audiences.

In addition, prior systems, while they may provide accommodation for displays to be attached to external panel surfaces, do not allow for the exhibition, directly on the panels of the system, of multi-paged informational booklets, pads, pamphlets, or brochures, such that these items can readily be reviewed and referenced in their entirety, while mounted on the system.

SUMMARY OF THE INVENTION

It is the object of the present invention to overcome the limitations and disadvantages of prior billboard display systems.

It is the object of the present invention to provide a multi-panel billboard display which is very lightweight and easily and readily convertible to several different display configurations.

It is another object of the present invention to provide a multi-panel billboard display which is compact and readily portable, either in one of its various display configurations or when collapsed in a non-display mode.

It is still another object of the present invention to provide a multi-panel billboard display which can be repeatedly used in its various display configurations.

It is a further object of the present invention to provide a multi-panel billboard display which can removably display and exhibit a variety of informational material and visual aids, designed to be secured to the billboard display by commonly used attachment means.

It is still another object of the present invention to provide a multi-panel billboard display which can removably retain booklets, pads, pamphlets, brochures, and other multi-page items for ready and full review and reference while mounted on the many different convertible configurations of the billboard display.

These and other objects are accomplished by the present invention, a very lightweight, easily portable, convertible billboard display having three display panels, rotatably connected to each other in parallel fashion. The billboard display can be used as a vertically standing three panel display or, when two of the panels are connected by a removable connection component, as a three dimensional triangular display. Informational display items can be removably attached to the display panels. In addition, pockets, variously located within each panel, allow for the insertion and display of and full access to multi-page display items, mounted directly on the billboard display.

The novel features which are considered as characteristic of the invention are set forth in particular in the appended claims. The billboard display itself, however, both as to its design, construction, and use, together with additional features and advantages thereof, are best understood upon review of the following detailed description with reference to the accompanying drawings.

DETAILED DESCRIPTION OF THE INVENTION

Figure 1:
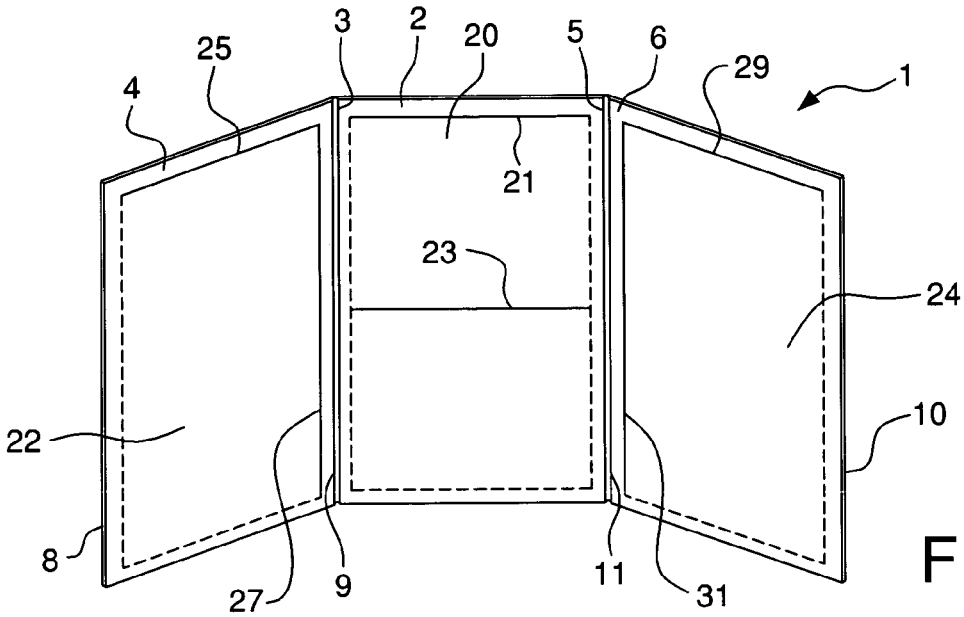
FIG. 1 shows a front view of the billboard display of the present invention standing in its extended, vertically upright, three panel configuration.

Billboard display 1 comprises center panel 2 and side panels 4 and 6, parallely aligned. It is contemplated that panels 2, 4, and 6 will be made of a rigid material, such as hard cardboard, light plastic, corkboard, chipboard, or similar comparable lightweight, yet sturdy material. The panels can be covered with a flexible plastic, cloth, or similar material sheathing which allows for the attachment of visual and informational aids by adhesive, Velcro®, tape, pushpins, or like means.

Side panel 4 has outer edge 8 and inner edge 9. Side panel 6 has outer edge 10 and inner edge 11. Inner edges 9 and 11 are connected to side edges 3 and 5 of panel 2 such that panels 4 and 6 can easily be rotated about the side edges of panel 2. This rotatable connection can be accomplished, for example, by enclosing the parallel aligned panels with material sheathing, thus allowing rotation at the edges of panels 2 and 4 and panels 2 and 6. Such a rotatable connection can also be made by providing small, universally rotatable hinges between the edges, or by flexibly rotatable bindings, or other comparable hinged type connection. The scope of the invention is not to be considered limited by the manner of rotatable connection of the panels.

Figure 2:
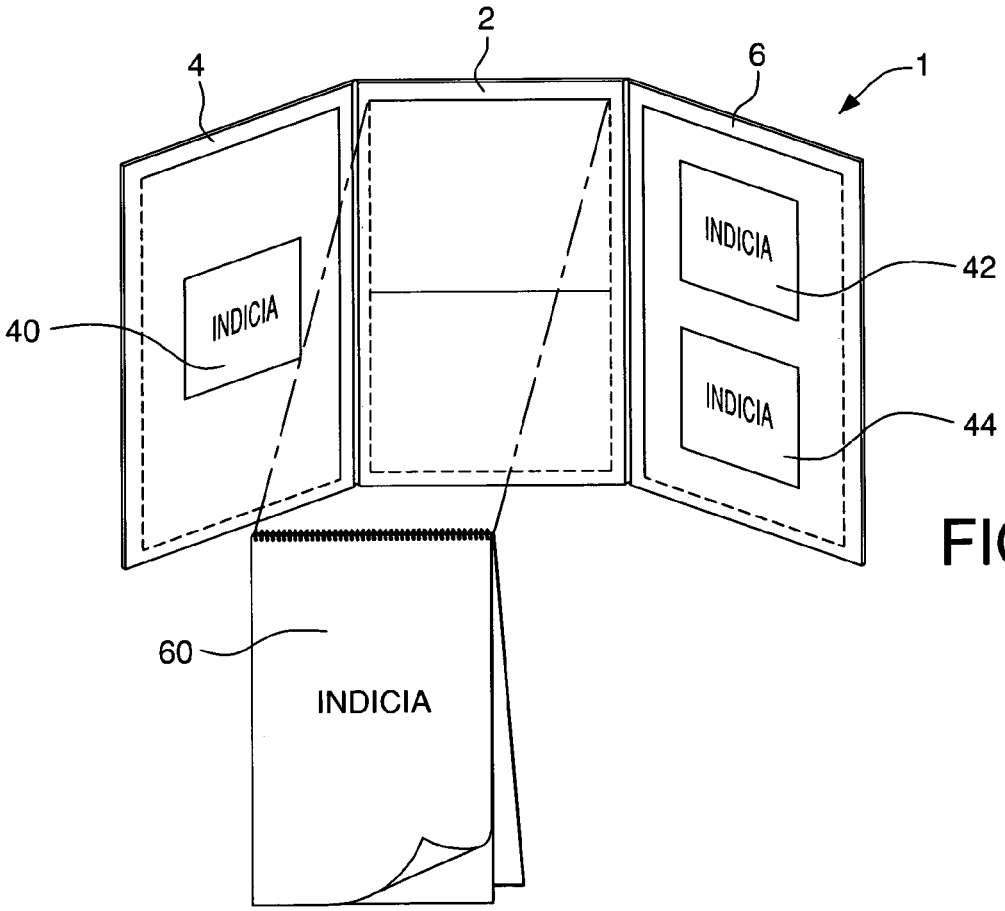
FIG. 2 shows a front view of the billboard display of the present invention standing in its extended, vertically upright three panel configuration with a multi-page display item positioned for insertion.
Figure 3:
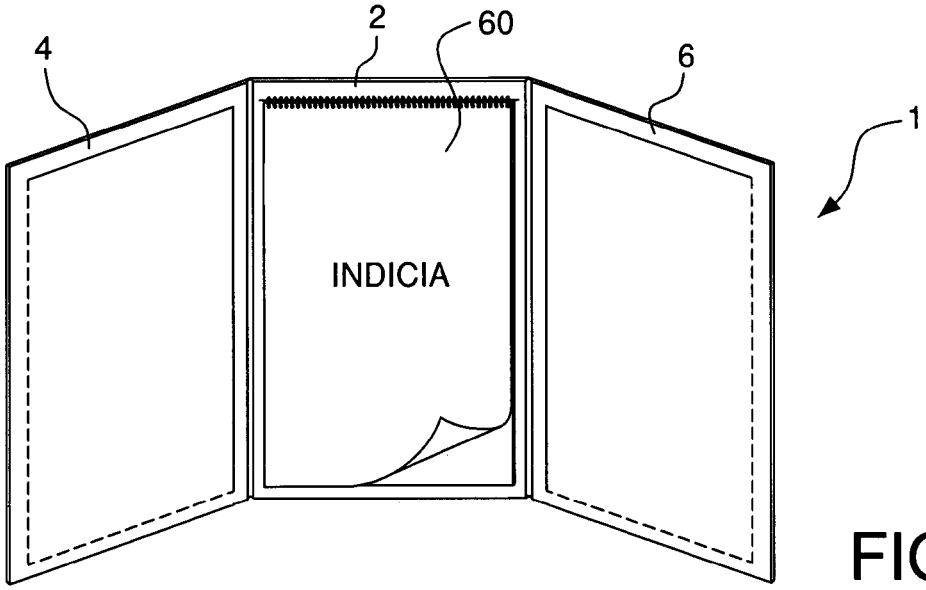
FIG. 3 shows a front view of the billboard display of the present invention standing in its extended, vertically upright panel configuration, with a multi-page display item in position within the central panel.

Billboard display 1 can be configured in various positions. For instance, all three panels 2, 4 and 6 can be vertically standing, as shown in FIGS. 1-3, for attaching and displaying items 40, 42 and 44 on the panels, as seen in FIG. 2.

Figure 4:
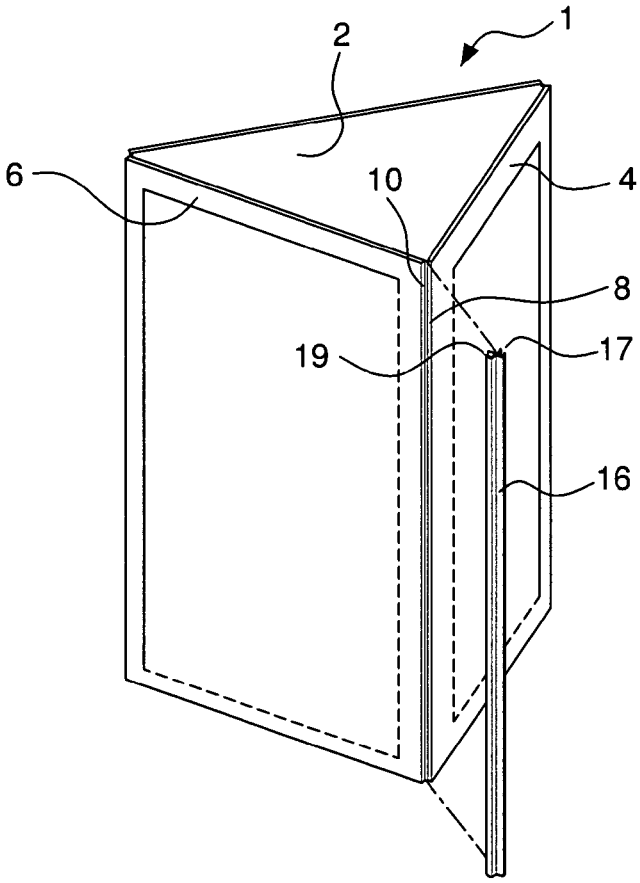
FIG. 4 shows an isometric view of the billboard display of the present invention in its folded, vertically standing, three dimensional triangular configuration prior to being secure in this position.
Figure 5:
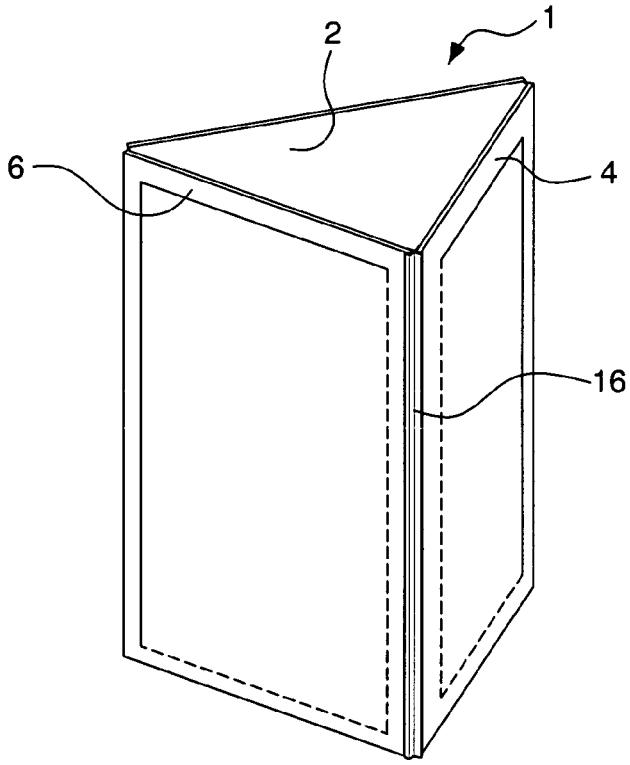
FIG. 5 shows an isometric view of the billboard display of the present invention in its folded, vertically standing, three dimensional triangular configuration secured in this position.
Figure 6:
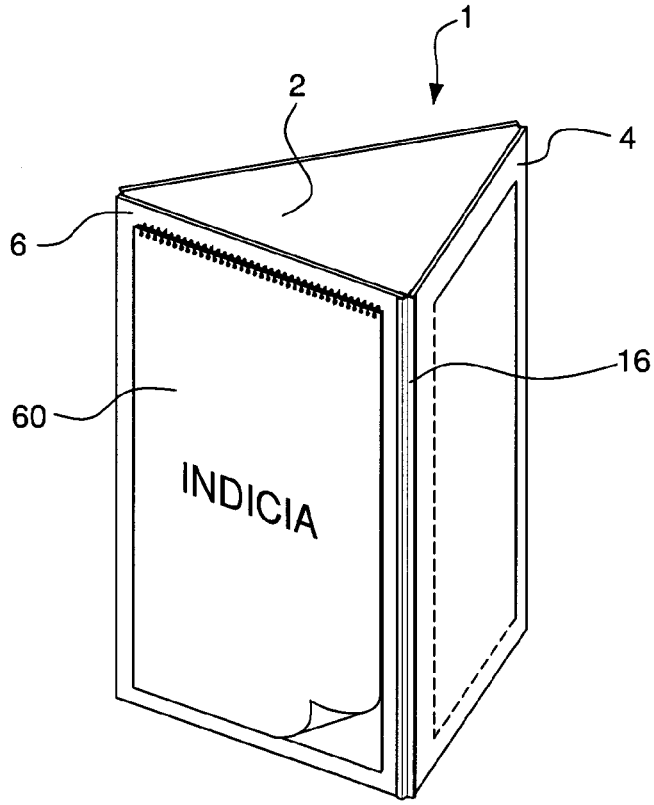
FIG. 6 shows an isometric view of the billboard display of the present invention in its folded, vertically standing, three dimensional triangular configuration, with a multi-page display item in position within one of the panels.
Figure 7:
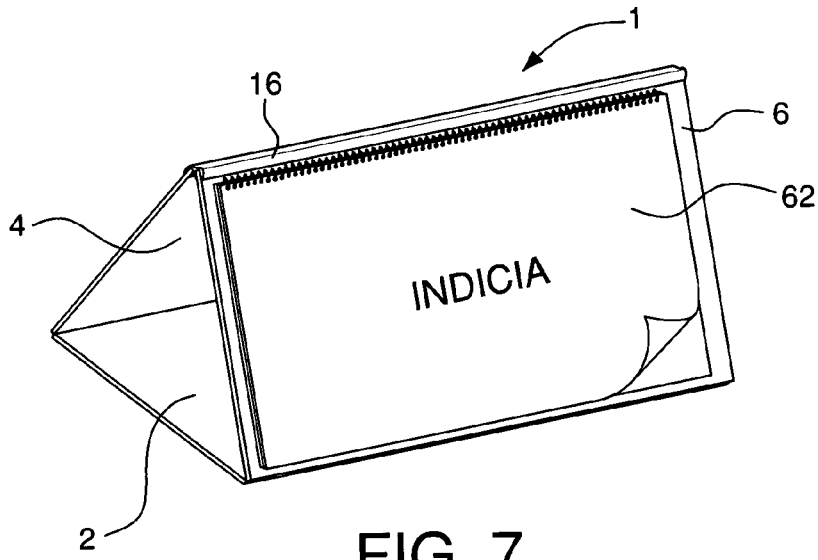
FIG. 7 shows an isometric view of the billboard display of the present invention in its folded, horizontally positioned, three dimensional, triangular configuration, with a multi-page display item in position within one of the panels.
Figure 8:
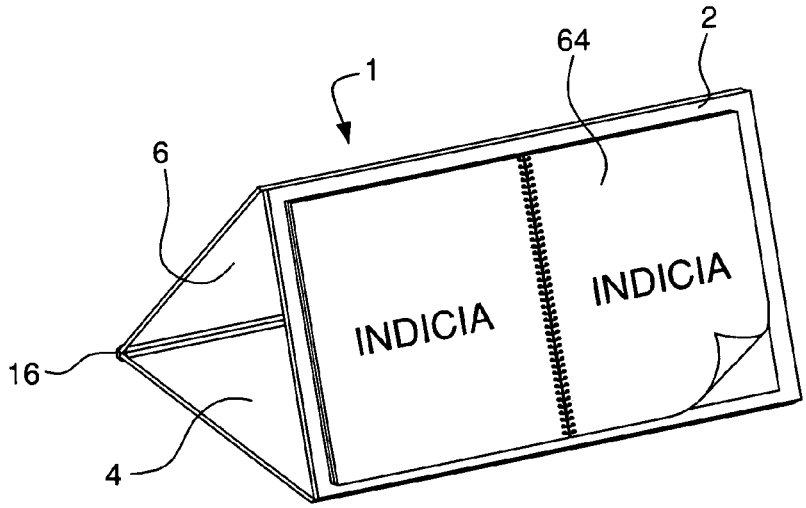
FIG. 8 shows an isometric view of the billboard display of the present invention in its folded, horizontally positioned, three dimensional triangular configuration, with an alternate multi-page display item in position within one of the panels.
Figure 9:
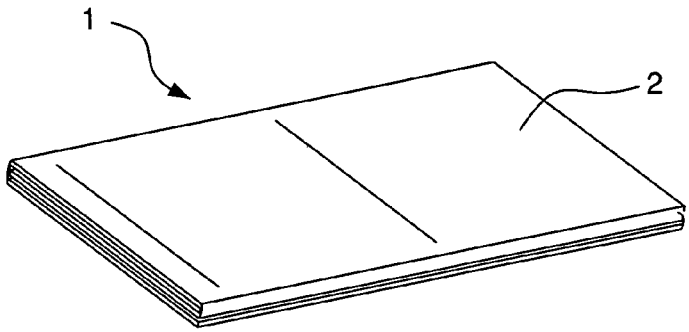
FIG. 9 shows the billboard display of the present invention, folded, in its transportable mode.

To form another configuration, panels 4 and 6 are rotated about their inner edges 9 and 11 respectively, such that their outer edges 8 and 10 are adjacent to each other as seen in FIG. 4. Elongated connector 16 has two channels 17 and 19 into which edges 9 and 11 are inserted. This forms billboard display 1 into a three dimensional, triangular, vertically standing three sided display, FIGS. 5 and 6. By rotating billboard display 1 90°, a different configuration is attained which allows two of the three panels to be used for displaying items and the third as a support base, as seen in FIGS. 7 and 8. When billboard display 1 is not in use and must be transported, connector 16 is removed. Panels 2, 4 and 6 can simply be rotated so they are folded one onto the other, see FIG. 9, such that billboard display 1 becomes substantially flat, making it easily transportable.

The three panels 2, 4 and 6, have features which allow for the insertion and retention of multi-page display items like booklets, pads, pamphlets, and brochures. These features comprise inset pockets 20, 22, and 24 within each panel. Slits 21, 23, 25, 27, 29, and 31 comprise the openings to the pockets, which allow for the insertion of a variety of multi-page items such as booklets, pads, pamphlets, brochures, and the like 60, 62, and 64. Pockets 20, 22, and 24 are variously configured in panels 2, 4, and 6, to allow for maximum versatility of billboard display 1. As a result, multi-page items 60, 62 and 64 can be mounted in a number of different locations on billboard display 1, depending on the configuration and position of the billboard display, as shown in FIGS. 2, 3, 6-8. Moreover, when multi-page items 60, 62 and 64 are mounted within the panels of billboard display 1, there is still full and ready access to all the pages of the item.

Billboard display 1 thus is an effective display tool, while providing versatility in display and simplicity in set-up, take-down, and portability.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A convertible billboard display comprising:

first billboard means for mounting displays;

second billboard means for mounting display items, said second billboard means having outer and inner edges, the inner edge being rotatably connected to the first billboard means;

third billboard means for mounting displays, said third billboard means having outer and inner edges, the inner edge being rotatably connected to the first billboard means;

means to removably attach the outer edges of the second and third billboard means, whereby when the outer edges are attached, two of the billboard means are always available for mounting display items thereon and the third billboard means provides a support base, and when the billboard display with outer edges attached is in a vertically standing position or when the outer edges are not attached, all of the three billboard means are available for mounting display items thereon, said means to attach comprising an elongated member with channels into which the outer edges of the second and third billboard means are inserted; and means inset within the first, second, and third billboard means for the insertion and positioning of alternate display items within at least one of the three billboard means.

2. The convertible billboard display as in claim 1 wherein the display items comprise removably attachable informational material.

3. The convertible billboard display as in claim 1 wherein the alternate display items comprise informational pads removably insertable into the billboard means.

4. The convertible billboard display as in claim 1 wherein the alternate display items comprise brochures removably insertable into the billboard means.

5. The convertible billboard display as in claim 1 wherein the alternate display items comprise booklets removably insertable into the billboard means.

6. The convertible billboard display as in claim 1 wherein the inset means comprise pockets formed within each billboard means.

7. The convertible billboard display as in claim 1 wherein when the outer edges are attached, the billboard display is a three dimensional, triangular shape.

8. The convertible billboard display as in claim 1 wherein when the outer edges are not attached, the billboard display forms a three panel, vertically standing display.

9. The convertible billboard display as in claim 1 wherein the first, second, and third billboard means are foldable, one on another, for portability of the billboard display.

10. A convertible billboard display comprising:

a first display panel;

a second display panel having outer and inner edges, the inner edges being rotatably connected to the first display panel;

a third display panel having outer and inner edges, the inner edges being rotatably connected to the first display panel;

means to removably attach the outer edges of the second and third display panels, whereby when the outer edges are attached, two of the three display panels are always available for mounting display items thereon and the third display panel provides a support, and when the billboard display with outer edges attached is in a vertically standing position or when the outer edges are not attached, the three display panels are available for mounting display items thereon, said means to attach comprising an elongated member with channels into which the outer edges of the second and third display panels are inserted; and inset means located within the display panels for the insertion and positioning of alternate display items within at least one of the display panels.

11. The convertible billboard display as in claim 10 wherein the display items comprise removably attachable informational material.

12. The convertible billboard display as in claim 10 wherein the alternate display items comprise informational pads removably insertable into the display panels.

13. The convertible billboard display as in claim 10 wherein the alternate display items comprise brochures removably insertable into the display panels.

14. The convertible billboard display as in claim 10 wherein the alternate display items comprise booklets removably insertable into the display panels.

15. The convertible billboard display as in claim 10 wherein the inset means comprise pockets formed within each display panels.

16. The convertible billboard display as in claim 10 wherein when the outer edges are attached, the billboard display is a three dimensional, triangular shape.

17. The convertible billboard display as in claim 10 wherein when the outer edges are not attached, the billboard display forms a three panel, vertically standing display.

18. The convertible billboard display as in claim 10 wherein the first, second, and third billboard means are foldable, one on another, for portability of the billboard display.

* * * * *